United States Patent [19]

Mikhail Ezzat A.

[11] Patent Number: 4,969,580

[45] Date of Patent: Nov. 13, 1990

[54] SHAMPOO AND HAIR CONDITIONER HANGER

[76] Inventor: Mikhail Ezzat A., 111 South La., Albert Lea, Minn. 56007

[21] Appl. No.: 270,521

[22] Filed: Nov. 14, 1988

[51] Int. Cl.[5] ..... B05B 11/04

[52] U.S. Cl. ..... 222/181; 248/311.3

[58] Field of Search ..... 222/181, 185, 174, 206, 222/212; 248/318, 311.3, 74.2; 215/100 R

[56] References Cited

U.S. PATENT DOCUMENTS

| | | | |
|---|---|---|---|
| 179 | 11/1857 | Goddard | 222/181 |
| 664,217 | 12/1900 | Jencke et al. | 248/360 X |
| 2,200,024 | 5/1940 | De Sipio et al. | 221/64 |
| 2,556,782 | 6/1951 | Venters | 222/181 |
| 2,740,562 | 4/1956 | Bello | 222/181 X |
| 3,059,374 | 10/1962 | Bernay | 248/318 X |
| 3,589,338 | 6/1971 | Lovitz | 119/51 |
| 3,813,072 | 5/1974 | Moore | 248/313 |
| 3,814,293 | 6/1974 | Daves | 222/173 |
| 3,856,209 | 12/1974 | Hickson | 239/532 |
| 3,860,048 | 1/1975 | White | 141/375 |
| 3,908,952 | 9/1975 | Von Alven | 248/360 |
| 3,945,366 | 3/1976 | Matthews | 222/481.5 X |
| 4,027,842 | 6/1977 | Mittleman | 248/318 X |
| 4,303,109 | 12/1981 | Cohen | 141/98 |
| 4,326,648 | 4/1982 | Kieber | 222/162 |
| 4,463,462 | 8/1984 | Greenhut | 4/605 |
| 4,548,340 | 10/1985 | Messer | 222/135 |
| 4,728,006 | 3/1988 | Drobish et al. | 222/181 |

FOREIGN PATENT DOCUMENTS

| | | | |
|---|---|---|---|
| 2098958 | 12/1982 | United Kingdom | 222/181 |

*Primary Examiner*—Michael S. Huppert

*Attorney, Agent, or Firm*—Kinney & Lange

[57] ABSTRACT

A hanger for shampoo or other personal care products has a bracket that hangs onto a pipe of a shower stall. The bracket includes a retainer for holding the cover end of an inverted bottle that has a dispensing spout of conventional design, and retains the bottle in place in the shower stall. The dispensing spot is accessible for operation by a person taking a shower. A securing strap can be placed around the bottle so that it can be held inverted on the frame for easy dispensing and use. The coat is low, the operation is simple, and the unit has a great utility for ready access and proper dispensing of shampoo, hair conditioner, soap and the like.

3 Claims, 2 Drawing Sheets

FIG. 2
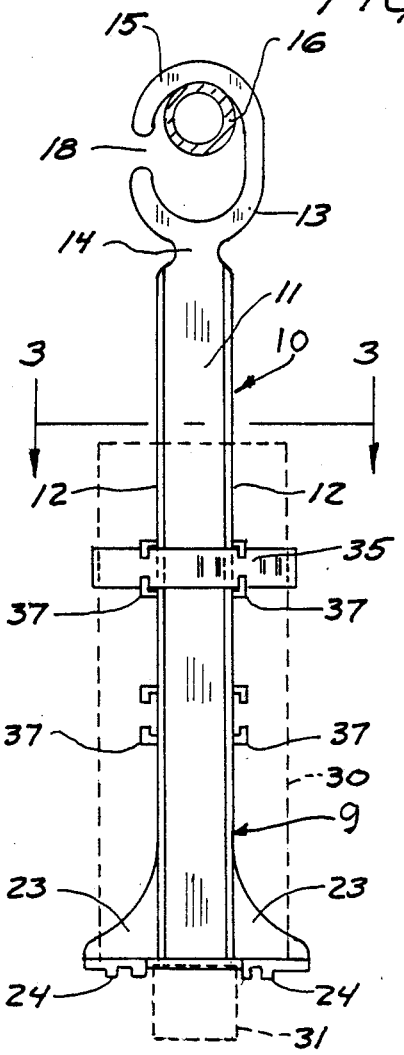
FIG. 1
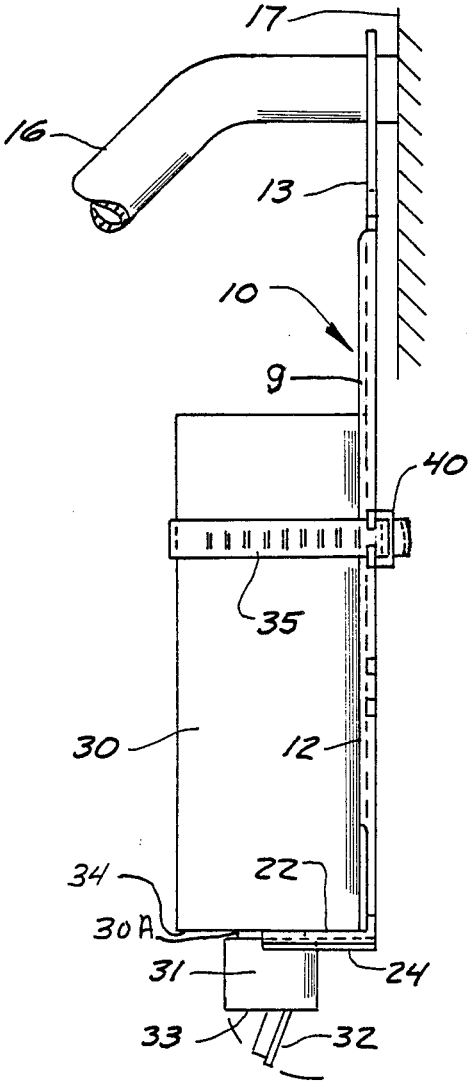
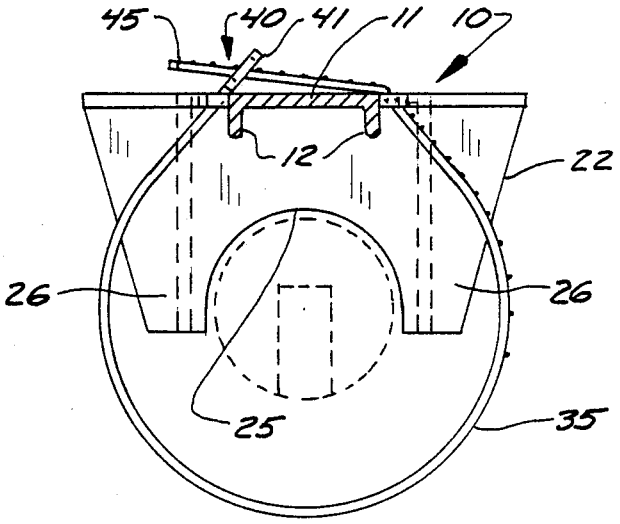
FIG. 3

SHAMPOO AND HAIR CONDITIONER HANGER

BACKGROUND OF THE INVENTION

1. Field of the Invention

The present invention relates to a hanger that will hold a wide variety of different types and sizes of bottles such as for shampoo or hair conditioner, securely and ready for use in a shower.

2. Description of the Prior Art

Various types of article holders have been advanced in the prior art. U.S. Pat. No. 664,217 has a hook at the top and an opening for an article at the bottom, and a clip for holding the article in place. The holder is designed for holding articles such as umbrellas or canes.

A bracket that fits onto a shower and holds a dispenser so that a liquid from a receptacle can be dispensed is shown in U.S. Pat. No. 3,813,072. This particular patent permits the liquid being dispensed to intermix with the shower water as the shower is being used. Bath oil is dispensed into the water of a shower from an inverted receptacle.

A type of soap dispenser which holds a container of soap inverted is shown in U.S. Pat. No. 2,200,024, and a shower dispenser is shown in U.S. Pat. No. 4,463,462, but this a complex arrangement that has receptacles that are latched in place and then tilted up for dispensing.

An inverted bottle holder is shown in U.S. Pat. No. 3,589,338. Other patents which show general type dispensing devices or supports are U.S. Pat. Nos. 4,326,648; 3,860,048; and 3,814,293. Holders for special applications are shown in U.S. Pat. Nos. 3,908,952 and 4,303,109.

A flush mounted liquid dispenser that is used with bath fixtures is shown in U.S. Pat. No. 4,548,340.

While the prior art shows various types of container holders to hold containers inverted, none show an easily mounted bracket that will hold a shampoo bottle securely and which can be placed on the shower water pipe, curtain rod, or hung on a bar of a soap dish in the wall of a shower, and which will conserve shampoo while having the shampoo readily available for use.

SUMMARY OF THE INVENTION

The present invention relates to a hanger or bracket that attaches with a hook or other fastener arrangement to a pipe, rod, soap dish bar or other support which is present in a shower stall. The hanger includes a frame having a support plate that supports the neck end of an inverted bottle, preferably having a dispensing type cap thereon so that the dispensing valve or cap, which can be opened for dispensing, is below the support plate and is readily available and accessible for use. When supported on the water outlet pipe or a soap dish, the hanger will rest against the wall of a shower at a location underneath and/or spaced from the shower head so that the hanger and the supported bottle or bottles are not sprayed with water.

The hanger preferably includes an adjustable and releasable retainer, such as a retaining strap that encircles the bottle and latches in place. The retainer also can be another type of fastener, such as a beaded plastic chain or a plastic strap now in use for plastic garbage bags. The strap can be molded integrally with the hanger if desired. The strap is a flexible plastic and has a series of spaced cross ribs on one surface. A rectangular slide loop or collar receives the other end of the strap and when the strap is loaded, one of the ribs will engage a side of the loop or collar and be retained to keep the strap loop closed. The strap can be easily released manually by disengaging the rib from the loop to let the strap be reversed and loosened.

The hanger holds the shampoo, hair conditioner or other bottle or bottles readily accessible for use, so that a mere flip of a conventional dispensing cap, which is commonly used for many liquids, will permit an amount of shampoo or other liquid or semi-liquid material to be metered out into the hands of the user, and then the cap can be closed for saving the material.

The hanger can be easily molded, with reinforcing ribs as desired, and as needed. The ribs shown may not be needed if the hanger is molded with thick walls of sufficient strength. A retainer strap can be held onto the support in any desired manner, although the disclosed retaining strap is preferred.

Low cost and ease of use are achieved.

BRIEF DESCRIPTION OF THE DRAWINGS

FIG. 1 is a side elevational view of a shampoo hanger made according to the present invention;

FIG. 2 is a front view of the device in FIG. 1;

FIG. 3 is a sectional view taken as on line 3—3 in FIG. 2 with parts removed and shown in phantom for sake of clarity;

DETAILED DESCRIPTION OF THE PREFERRED EMBODIMENTS

Figure 4:
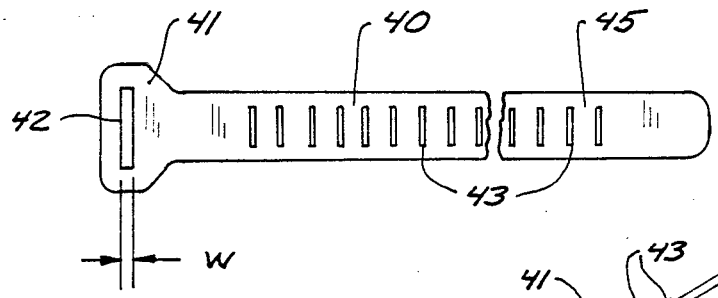
FIG. 4 is a fragmentary plan view of a retainer strap used with the present mounting.

A liquid material bottle hanger or support bracket indicated generally at 10, comprises a hanger frame 9 which has an elongated back support bar 11 that is molded of suitable plastic and has reinforcing ribs 12 along its longitudinal edges (if needed for strength) to provide rigidity along the longitudinal axis of the bar. The molded hanger can be made of Lexan, Delrin, polyethylene or other plastics of suitable strength and rigidity. A hook 13 is molded integrally with the back bar 11, at a junction region 14, and as can be seen, the molded hook 13 is a substantially closed C-shape that has an upper support end 15 that fits over a water pipe 16, shower curtain rod, a soap dish bar or other support in a conventional shower. The water pipe shown extends from the wall 17 of a shower stall.

The hook 13 has an opening 18 that will permit placing the hanger over the water pipe 16 or other support when the upper end portion 15 is bent out of the plane of the bar 11 and hook 13. The opening 18 is of smaller transverse size than the diameter of the pipe on which it is supported, until the top part of the hook is twisted. This insures that the hook 13 will not easily come off the support pipe during use, or at some unwanted time.

A bottle support plate 22 is integrally molded to bar 11 at the lower end of the bar 11. The plate 22 has a plane that extends at right angles to the plane of the bar 11. The plate 22 is wider than the bar as shown in FIG. 2, and is joined to the bar 11 with suitable gusset wall portions 23 on opposite sides of the bar. The plate 22 can have suitable reinforcing ribs 24 on the lower surface thereof to provide rigidity on opposite sides of a recess or notch indicated at 25 (FIG. 3) that is formed in the center portions of the plate 22. The ribs do not have to be used if the plate is of sufficient thickness. The plate 22 thus has support surfaces indicated at 26 formed on opposite sides of the recess or notch 25.

A bottle 30 of conventional design for shampoo, hair conditioner or other product used in a shower includes a conventionally available dispensing cap 31 that is threaded onto the neck 30A of the bottle 30. The cap 31, as shown, includes a valved dispensing spout 32 that can be pivoted as shown in FIG. 1 for dispensing material, but when folded up against the top surface 33 of the cap, it shuts off flow. Different types of dispensing caps can be used.

The bottle 30 can be of suitable size, so that one end wall 34 which extends laterally in from the outer wall of the bottle near the cap, will rest against the support surfaces 26 on the plate 22. The notch 25 will receive the neck 30A so the surfaces 26 fit along opposite sides of the cap 31 and the neck 30A to which the cap 31 is attached. The side wall of the bottle 30 rests against the bar 11, and/or the ribs 12 that are used for reinforcing. The bottle is retained on the hanger frame with a suitable retainer such as that indicated at 35 which as shown comprises a strap that passes through first retainer lugs 37 on opposite sides of the bar 11. The retainer lugs 37 are loops which receive the strap 35 to hold the strap in place, much like belt loops. The loops 37 can be continuous loops or can be formed as two end segments forming the strap retainer function as shown. The strap then can be moved into place from the side.

Figure 5:
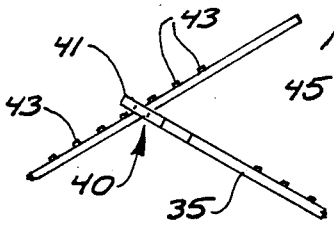
FIG. 5 is a fragmentary view showing a latched position of the strap of FIG. 4.

The strap 35 has a suitable fastener system 40 for holding it around the bottle 30 and securely retaining the bottle in position against the bar 11 and on the support plate 22. The fastener system 40 is shown in FIGS. 4 and 5 and as shown includes a reinforced loop 41 that has an opening 42 therein. The loop has a wide end (outer) wall and side walls to provide sufficient strength so the fastener strap can be tightened down. The strap has a plurality of spaced, parallel ribs 43 on one side surface and the height of the ribs, plus the thickness of the strap, is preferably greater than the width of opening 42, represented as "W" in FIG. 4. Thus, the walls defining loop 41 have to deform to permit the end portion 45 of the strap to slide through the opening 42. The ribs then will tend to lock the strap in position because it requires some force to deform the loop to remove the end portion of the strap from the loop.

As shown, the fastener system 40 can be placed between the bar 11 and the shower stall wall so the fastener is out of the way. Other fasteners can also be used, and can be placed in any location. Hooks, wedge fasteners, and snaps all will work as fasteners.

Some means for retaining the bottle against the support bar 11 of the frame is required for satisfactory operation so the bottle used will not fall off the frame.

When the bottle has been retained with respect to the bar 11, the hook 13 can be deformed slightly and placed over the water pipe 16 (or other support) so that the top portion 15 of the hook supports the hanger 10 in position for use. It can be seen that shampoo or hair conditioner bottles 30 can be readily interchanged by loosening the support strap fastener 40 and placing another bottle in position. The strap 35 can be molded from the same material as the hanger frame and can be integrally molded with the hanger frame support bar 11. A readily made, low cost and easily used hanger for shampoo or hair conditioner bottles is thus provided. The bottle encircling loop formed by the fastener strap does not have to be extremely tight either, so once formed, the loop can be left in place and bottles removed and replaced without changing the strap.

Various configurations of the bottle hanger can be advanced, and the support hook does not necessarily have to be of the form shown in FIG. 2. The hook can be made so that it will hang on a shower curtain rod, or cross rod or soap dish, and can be a latch type or snap hook such as is used for shower curtains. It can also be an ordinary C-hook.

Figure 6:
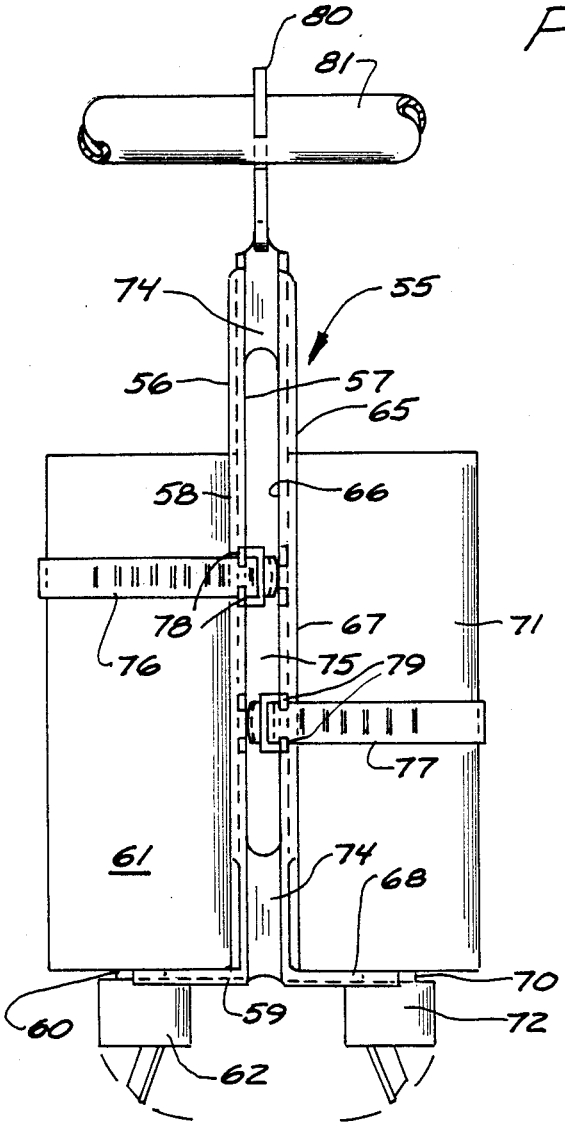
FIG. 6 is a side view of a modified form of the present invention.

The bottle hanger can be made molded so two bottles can be held on one hanger, generally as shown in FIG. 6, where there is a double bottle hanger indicated generally at 55. Hanger 55 is molded as a unitary hanger but has two sections for supporting bottles, including a first frame section 56, which is substantially the same construction as the hanger in the previous form of the invention. Frame section 56 has an upright support bar 57, with ribs 58 for strengthening it in the same manner as shown before. Also, the first frame section 56 has a support plate 59 integral with the bar 57, and support plate 59 is made the same as support plate 22. It extends at right angles to the plane of the bar 57. The plate 59 has a recess therein to receive the neck indicated generally at 60 of a shampoo bottle 61, for example, which has a dispensing cap 62.

A second frame section 65 of the hanger 55 is made substantially the same as frame section 56 and has a support bar 66, reinforcing ribs 67, and a support plate 68 that has a recess to receive the neck 70 of a hair conditioner bottle 71, for example. Hair conditioner bottle 71 has a dispensing cap 72, as previously explained in relation to shampoo bottles.

The support plates 59 and 68 extend outwardly in opposite directions. Molded webs 74 form part of the unitary bracket frame and provide an opening or space 75 through which fastener members or holding straps 76 and 77 can pass. The straps 76 and 77 are made as previously explained and are held in retainer loops or supports 78 and 79. It can be seen that for example, in the previous form of the invention, that two sets of the retainer loops for the straps can be provided, so that the bottle fastener straps can be at different levels on the respective bottles.

In this form of the invention, the hanger 55 has a hook 80 which is joined to the web 74 and can be placed over a shower curtain rod 81. It should be noted that the hook 80 could be made at right angles to the position shown so that it could be hooked with both bottles supported as shown in the assembly 55 and then hooked over a water pipe extending from the wall of the shower so that the bottles would be side-by-side and rest against the wall of the shower.

Figure 7:
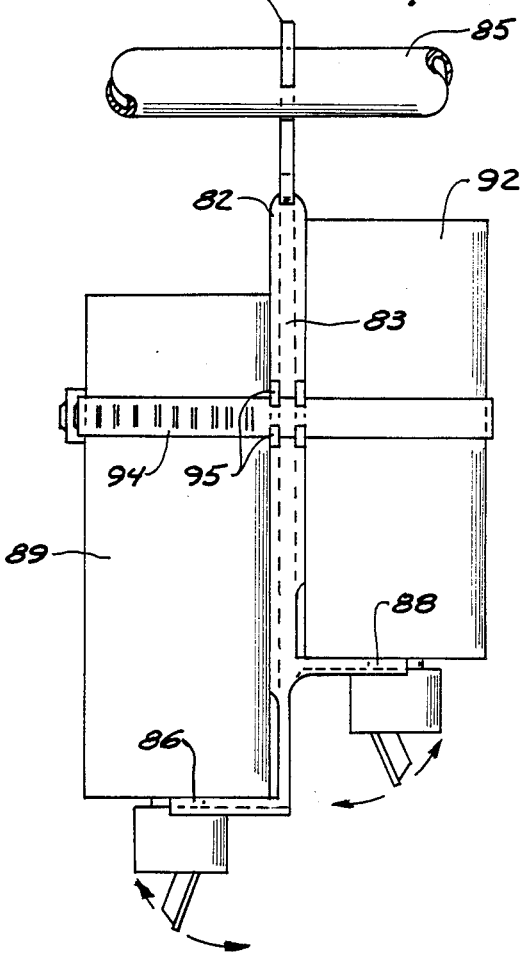
FIG. 7 is a fragmentary side view of a further modified form of the invention.

FIG. 7 illustrates a molded hanger 82, that has a main upright support bar 83 and a hook 84 at the upper end of the support bar for supporting the hanger 82 on a support pipe or soap dish bar 85. The support bar 83 of the hanger also can have longitudinally extending ribs on the outwardly facing sides thereof, so that in horizontal cross-section the hanger would appear as in FIG. 3, with two of the FIG. 3 hangers placed back-to-back.

The support bar 83 has a first support plate 86 molded thereon at the lower end thereof and extending laterally outwardly at a first level, and a second support plate 88 is molded to the support bar 83 and extends from the bar 83 in opposite direction from the plate 86, but at a different level relative to the support hook.

The support plates 86 and 88 are made in the same manner as plate 22, and each support plate includes a notch for receiving the neck of a bottle for supporting the bottle inverted, with a dispensing cap extending downwardly from the respective support plate. As shown, a shampoo bottle 89 can be provided on the support plate 86, and a hair conditioner bottle 92 can be supported on support plate 88.

The different vertical orientation or height of the support plates 86 and 88 permits identifying the type of bottle supported on the respective plate by touch or feel. The lower support plate is for shampoo, and the higher support plate is for conditioner (or vice versa). Different size bottles also can be supported on the support plates as well. The different levels or staggering of the support plates for the bottles is to provide feel identification.

For simplicity, a retainer strap 94 can be used, to fit around both bottles 89 and 92, and the strap can be held on the support bar 83 by retainers 95 positioned on opposite sides of the support bar. The strap 94 can be replaced with separate retainers for each bottle if desired. The material from the bottles can be dispensed using the dispensing caps of the respective bottles as previously explained. The offset of the support plates again permits identification of the material to be dispensed by touch.

The support plates of course are unitarily molded with the support bar 83 and the hanger 84 so that a complete molded assembly can be made in this manner.

Again, the various ribs that are shown for reinforcing can be eliminated if the sections of the support bar and the support plates are sufficiently heavy to provide strength that is needed.

The hangers are convenient, easy to use and keep needed supplies organized and handy. The bottles will not fall on the shower floor or be knocked off small ledges. The use of the materials also is conserved because the correct amount of material can be dispensed and then stopped.

Although the present invention has been described with reference to preferred embodiments, workers skilled in the art will recognize that changes may be made in form and detail without departing from the spirit and scope of the invention.

What is claimed is:

1. A hanger support apparatus for use in a shower with a bottle having a neck and a dispensing cap at one end thereof, said one end having an end wall that extends laterally of the neck to a side wall of such bottle, said hanger comprising a frame, said frame being elongated along a longitudinal axis and having hook means for supporting the frame at one end thereof, and a support plate at an opposite end thereof, said support plate extending at generally right angles to the longitudinal axis of the frame and having a support surface thereon facing toward the means for supporting at the one end of the frame, said support surface being configured to engage the one end wall of a bottle to be supported on the support plate while permitting the dispensing cap and neck of such bottle to extend beyond the support plate in direction of the longitudinal axis, and releasable means for securing a bottle to said frame with the one end wall supported on said support plate, the means for retaining a bottle on said frame comprising a strap that surrounds the frame and which has means for adjustably securing the strap to the frame to hold the bottle in position on the support plate, the means for adjustably securing said strap comprises a loop at one end of said strap, said loop having an aperture therethrough that is of a selected dimension measured in direction along the length of said strap, and the opposite end portion of said strap having a plurality of individual, spaced-apart raised ribs, wherein the ribs are formed so that the total height of the ribs plus the thickness of the strap is greater than the selected dimension of the aperture in the loop, said strap being made of a slightly flexible plastic to permit the ribs to be forced through said loop, said strap having a length and a width, and said loop extends outwardly beyond lateral sides of said strap to have an overall transverse dimension greater than the width of the strap, said loop having a cross-section sufficient to resist tension loads tending to pull the opposite end portion of the strap from the aperture in the loop after the opposite end portion of the strap has been passed through the loop.

2. The apparatus as specified in claim 1 wherein a second support plate is fixed at said opposite end of said frame, said second support plate extending at generally right angles to the longitudinal axis of the frame and in an opposite direction from the first-mentioned support plate, said second support plate having a second support surface thereon facing toward the means to support at the one end of the frame, said second support surface being configured to engage an end of a bottle to be supported on said second support plate while permitting a dispensing cap and neck of such bottle to extend beyond the second support plate in direction of the longitudinal axis, the support plates being staggered relative to each other in direction along the longitudinal axis.

3. A hanger apparatus for a bottle having a neck at one end thereof and a dispensing cap on the neck, said one end of the bottle having an end wall that extends laterally of the neck to side walls of the bottle, said hanger comprising a frame having a generally narrow elongated bar with a longitudinal axis, and having hook means at one end thereof, a bottle support plate at an opposite end thereof, said bottle support plate generally defining a plane extending at right angles to the longitudinal axis of the frame and having a support surface thereon facing toward the means to support at the one end of the frame, said support plate having a recess defined therein to bifurcate the outer portions of said support plate at an edge thereof opposite from the frame and the recess being of size to fit around the neck of the bottle, and having support surface portions that engage the end wall of the bottle when the neck is in place in the recess, the cap of said bottle extending downwardly from the support plate for access to the dispensing cap when the frame is supported by the hook means at said one end, and a second support plate fixed to said frame and spaced from the means to support indirection of the longitudinal axis of the elongated bar, said second support plate extending at generally right angles to the longitudinal axis of the bar and extending in an opposite direction from the first-mentioned support plate, said second support plate having means to support a second bottle thereon, and being offset from the first support plate in longitudinal direction of said elongated bar.

* * * * *